US006595724B2

(12) United States Patent
Konda et al.

(10) Patent No.: US 6,595,724 B2
(45) Date of Patent: Jul. 22, 2003

(54) TUNNEL EXCAVATING MACHINE AND EXCAVATING METHOD

(75) Inventors: Shinichi Konda, Kobe (JP); Hirohiko Obayashi, Kobe (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/870,721

(22) Filed: Jun. 1, 2001

(65) Prior Publication Data

US 2002/0031403 A1 Mar. 14, 2002

(30) Foreign Application Priority Data

Jun. 1, 2000 (JP) ..... 2000-164107

(51) Int. Cl.[7] ..... E21D 9/06

(52) U.S. Cl. ..... 405/141; 405/138; 405/146; 405/147

(58) Field of Search ..... 405/146, 141, 405/142, 143, 144, 145, 150.1, 151, 138, 132

(56) References Cited

U.S. PATENT DOCUMENTS 3,905,645 A * 9/1975 Bland ..... 405/146
4,095,436 A * 6/1978 Heitkamp et al. ..... 405/142
4,627,765 A * 12/1986 Hentschel ..... 405/146
4,804,295 A * 2/1989 Kondo ..... 405/146
4,813,813 A * 3/1989 Yamamoto et al. ..... 405/146
5,221,160 A * 6/1993 Azuma et al. ..... 405/141
6,092,963 A * 7/2000 Miya et al. ..... 405/141

FOREIGN PATENT DOCUMENTS

JP 05332095 * 12/1993
JP 08121082 * 5/1996
JP A9209684 8/1997

* cited by examiner

*Primary Examiner*—Heather Shackelford
*Assistant Examiner*—Frederick Lyndon Lagman
(74) *Attorney, Agent, or Firm*—Birch, Stewart, Kolasch & Birch, LLP

(57) ABSTRACT

A tunnel excavating machine of high-speed construction capable of completely stopping invasion of water and allowing covering members to be assembled easily is provided. This tunnel excavating machine comprises: a cylindrical excavating machine main portion 1 provided with a cutter head 4 and fit to an external periphery of an existing segment S through a tail seal 23; a cylindrical excavating machine auxiliary portion 2 fit to the inside of the excavating machine main portion 1 movably in the back and forth directions and provided with an erector 25 for assembling the segments; a plurality of main propulsion jacks 22 disposed between the main portion 1 and the auxiliary portion 2; and a plurality of auxiliary propulsion jacks 22 mounted on the auxiliary portion 2 and capable of being retracted with respect to the segment S.

11 Claims, 11 Drawing Sheets

TUNNEL EXCAVATING MACHINE AND EXCAVATING METHOD

The entire disclosure of Japanese Patent Application No. 2000–164107 filed on Jun. 1, 2000 including specification, claims, drawings and summary is incorporated herein by reference in its entirety.

BACKGROUND OF THE INVENTION

1. Field of the Invention

The present invention relates to a tunnel excavating machine for excavating and forming a tunnel in the ground and an excavation method therefor.

2. Description of the Related Art

Recently, upon excavating and forming a tunnel, reduction of construction period of the tunnel has been strongly demanded and high-speed construction thereof with a tunnel excavating machine has been an important theme.

For the reason, after the excavating machine main body such as a shield excavating machine is propelled by a stroke so as to excavate, the excavation is interrupted temporarily and then covering members are assembled. After this assembly, by applying propulsion reaction to the covering members again, the excavating machine is propelled. Instead of this type of the ordinary tunnel excavating machine, various types of tunnel excavating machines capable of allowing the covering members to be assembled under propulsion and excavation of the excavating machine main body have been developed.

For example, there is well known such a tunnel excavating machine, whose main body is divided into a front cylinder and a rear cylinder such that they are fit to each other retractably (telescopic) and while excavating by propelling the front cylinder with respect to the rear cylinder, segments are assembled in the rear cylinder at the same time.

Further, there is well known another tunnel excavating machine which is provided with a long (two strokes long) shield jack and assembly of the segments is started when excavation by a stroke is completed while excavation by a remaining stroke is carried out at the same time.

However, in the former tunnel excavating machine, in case where excavating a ground in which soil and water pressure apply, stopping of water at a retracting portion (fitting portion) of the front cylinder and the rear cylinder is indispensable so that a sealing mechanism is provided. However, because sand and soil enter into the retracting portion accompanied by that retracting motion, there is a problem that the sealing mechanism is damaged easily.

Further, in the latter tunnel excavating machine, because an erector for assembling the segments moves with the excavating machine main body, it moves relative to the existing segments. Therefore, there is another problem that positioning of the segment is very difficult.

SUMMARY OF THE INVENTION

The present invention has been achieved in views of the above described problems and an object of the invention is to provide a tunnel excavating machine of high-speed construction type and an excavation method which is capable of stopping water invasion completely and allows covering members to be assembled easily.

To achieve the above object, the present invention is directed to a tunnel excavating machine comprising: a cylindrical excavating machine main portion which is provided with a cutter head mounted rotatably at a front portion thereof and fit to an external periphery of a covering member through a sealing member; a cylindrical excavating machine auxiliary portion which is fit to the inside of the excavating machine main portion movably in the back and forth direction and provided with an erector for assembling the covering members; a plurality of main propulsion jacks disposed between the excavating machine main portion and the excavating machine auxiliary portion; and a plurality of auxiliary propulsion jacks mounted on the excavating machine auxiliary portion and capable of being retracted with respect to the covering member, wherein assembly of the covering members is enabled under propulsion and excavation with the excavating machine main portion.

Another feature of the present invention is that the plurality of the auxiliary propulsion jacks are connected to separate hydraulic pressure sources each having the same capacity through each of retractable selection valves.

Still another feature of the present invention is that the plurality of the auxiliary propulsion jacks are so controlled that at the time of extension motion, the plurality of the auxiliary propulsion jacks are controlled as a group, while at the time of retraction, each of the auxiliary propulsion jacks is controlled separately.

Further, the present invention provides a tunnel excavation method wherein, upon excavating and forming a tunnel with the aforementioned tunnel excavating machine, after executing a first step of, with a main propulsion jack extended from an initial position in which the main propulsion jack and an auxiliary propulsion jack are both retracted, propelling an excavating machine main portion, a second step of, with the auxiliary propulsion jack extended while retracting the main propulsion jack, propelling the excavating machine auxiliary portion, and a third step of, while propelling the excavating machine main portion with the main propulsion jack extended, retracting the auxiliary prolusion jack partially in succession so as to assemble covering members with an erector, the second step and the third step are repeated.

DETAILED DESCRIPTION OF THE PREFERRED EMBODIMENT

Hereinafter, an embodiment of the tunnel excavating machine and excavation method of the present invention will be described in detail with reference to the accompanying drawings.

Figure 1:
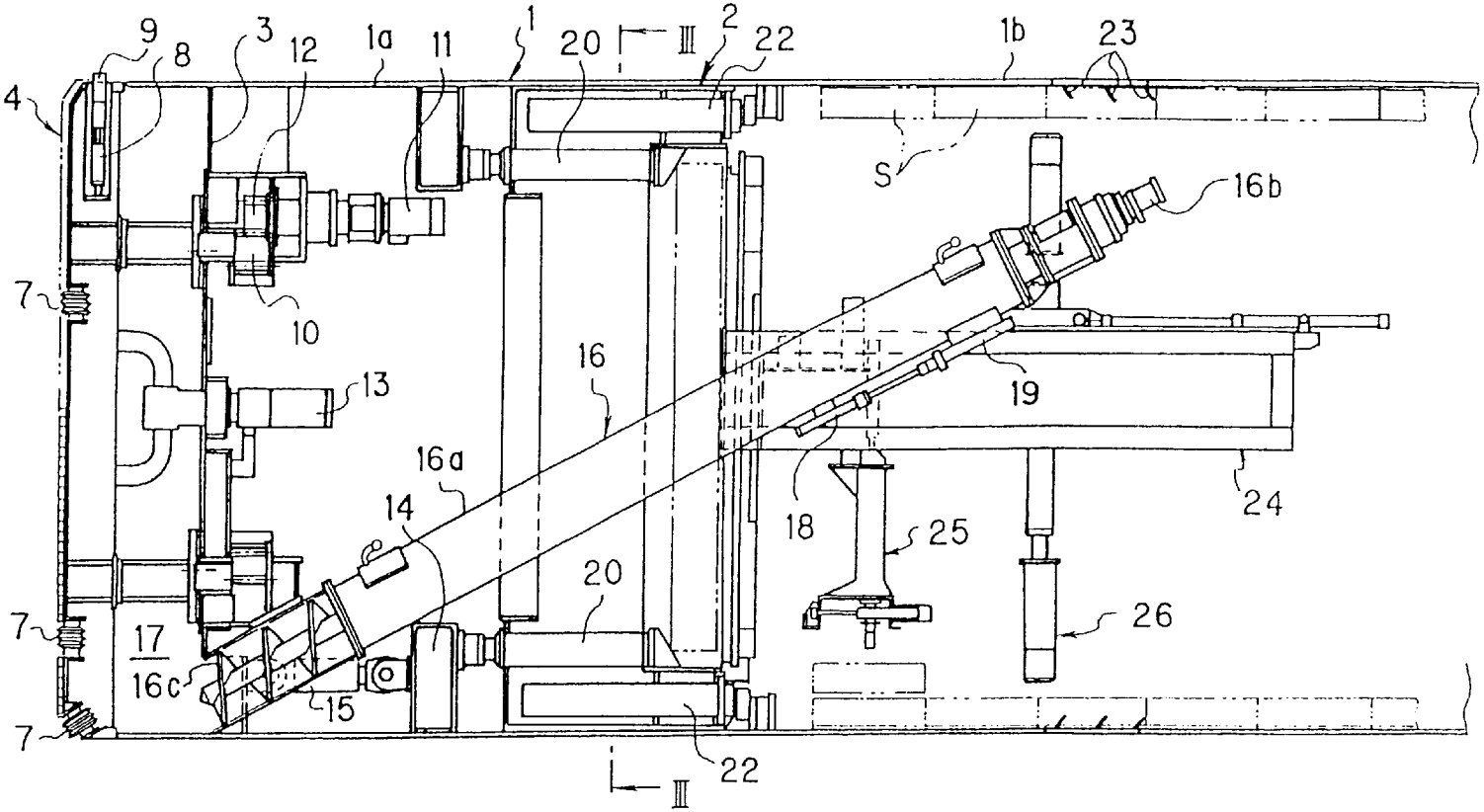
FIG. 1 is a side sectional view of an earth pressure type shield excavating machine as a tunnel excavating machine according to an embodiment of the present invention.
Figure 2:
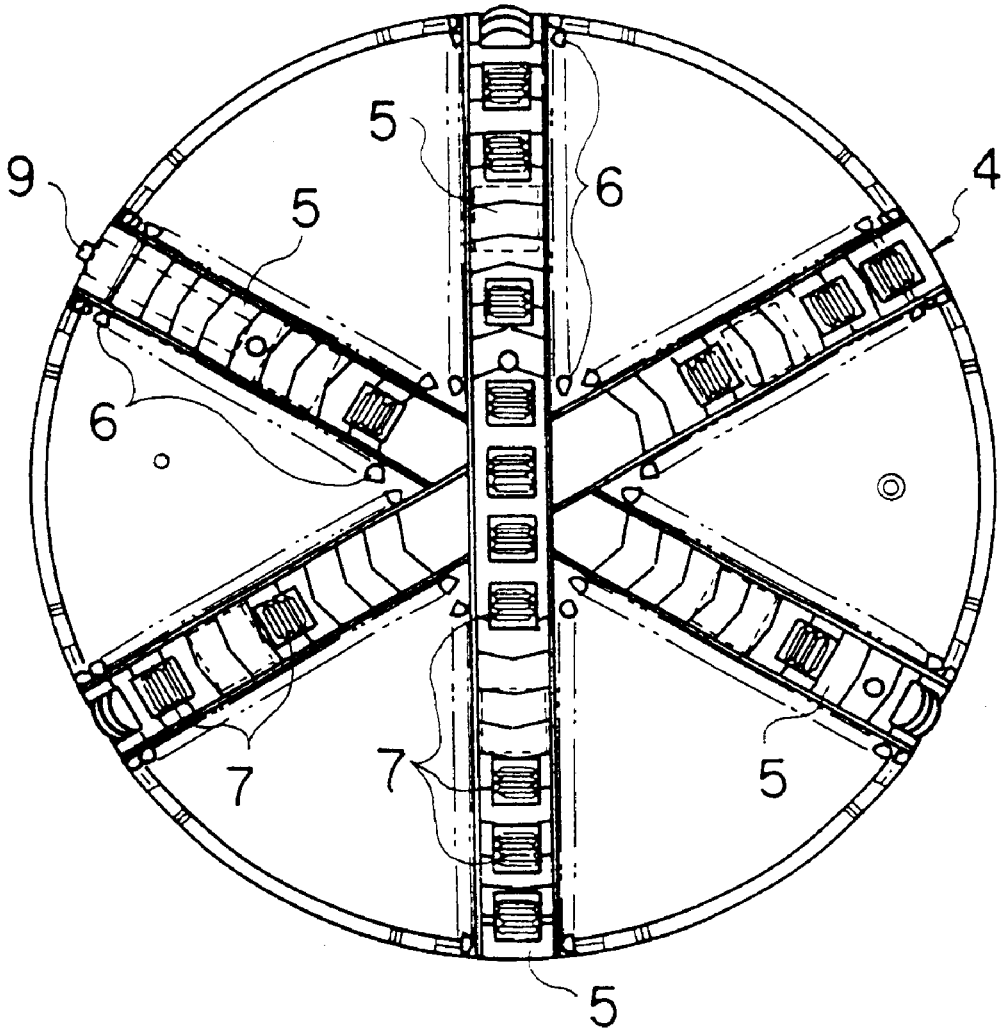
FIG. 2 is a front view of the same.
Figure 3:
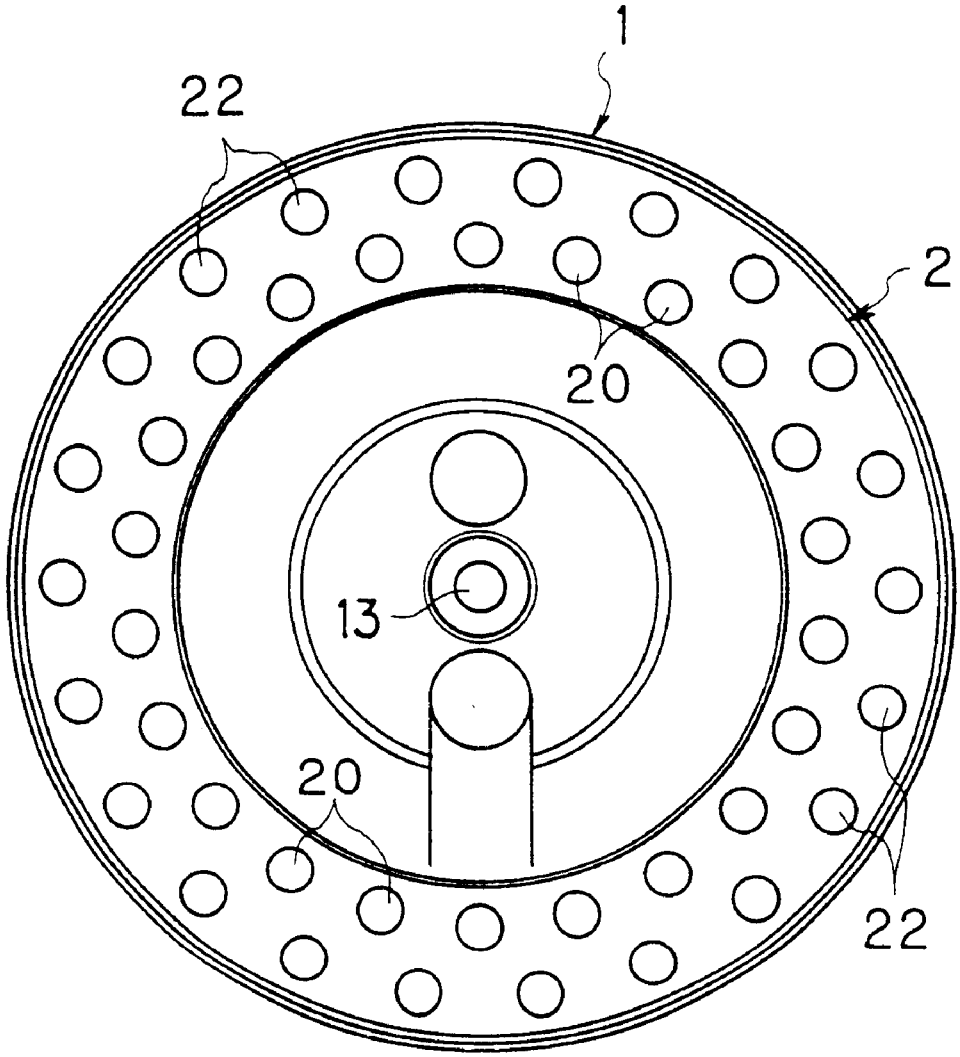
FIG. 3 is a sectional view taken along the line III—III of FIG. 1.
Figure 6:
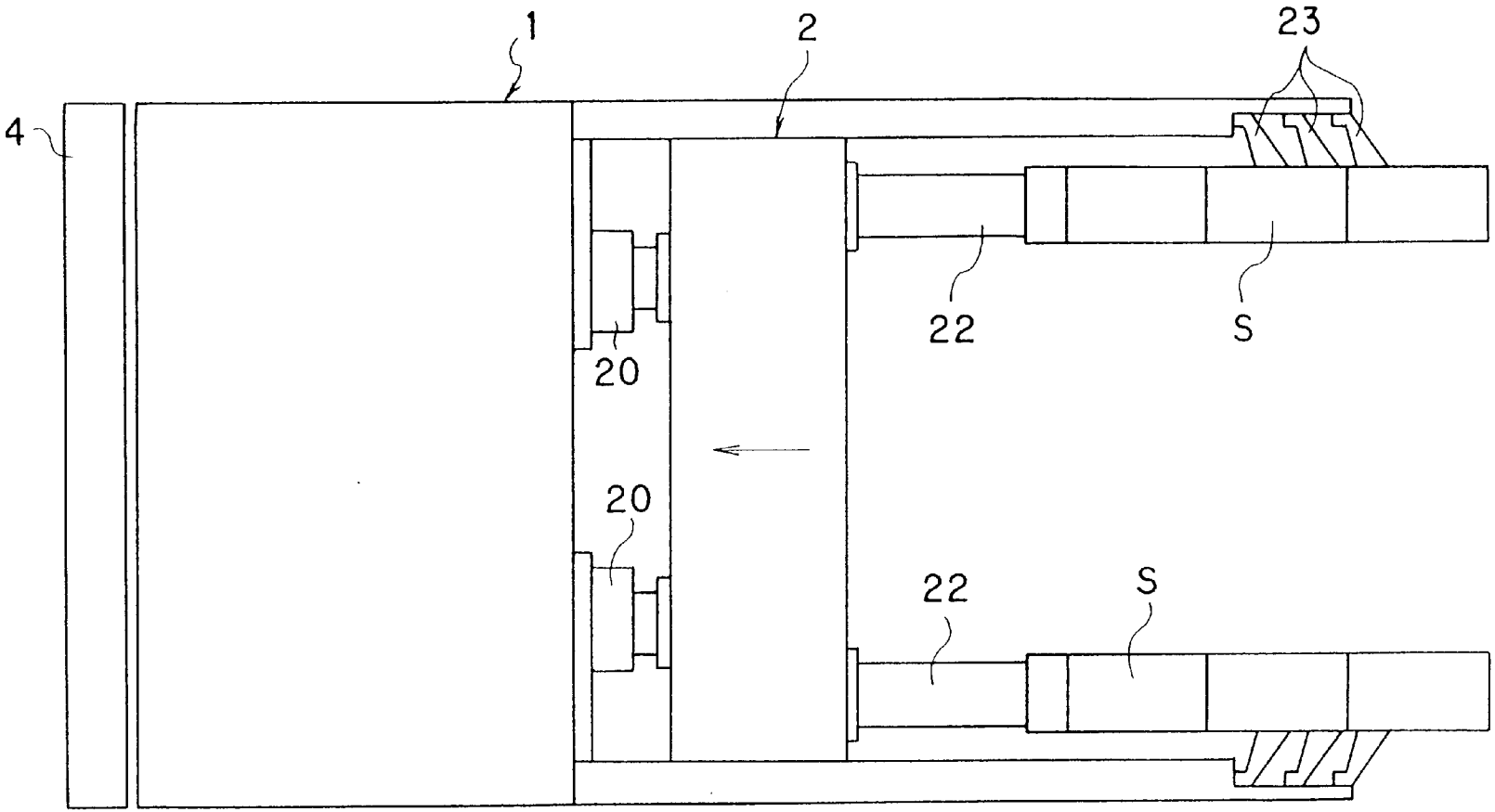
FIG. 6 is an excavating process diagram.
Figure 7:
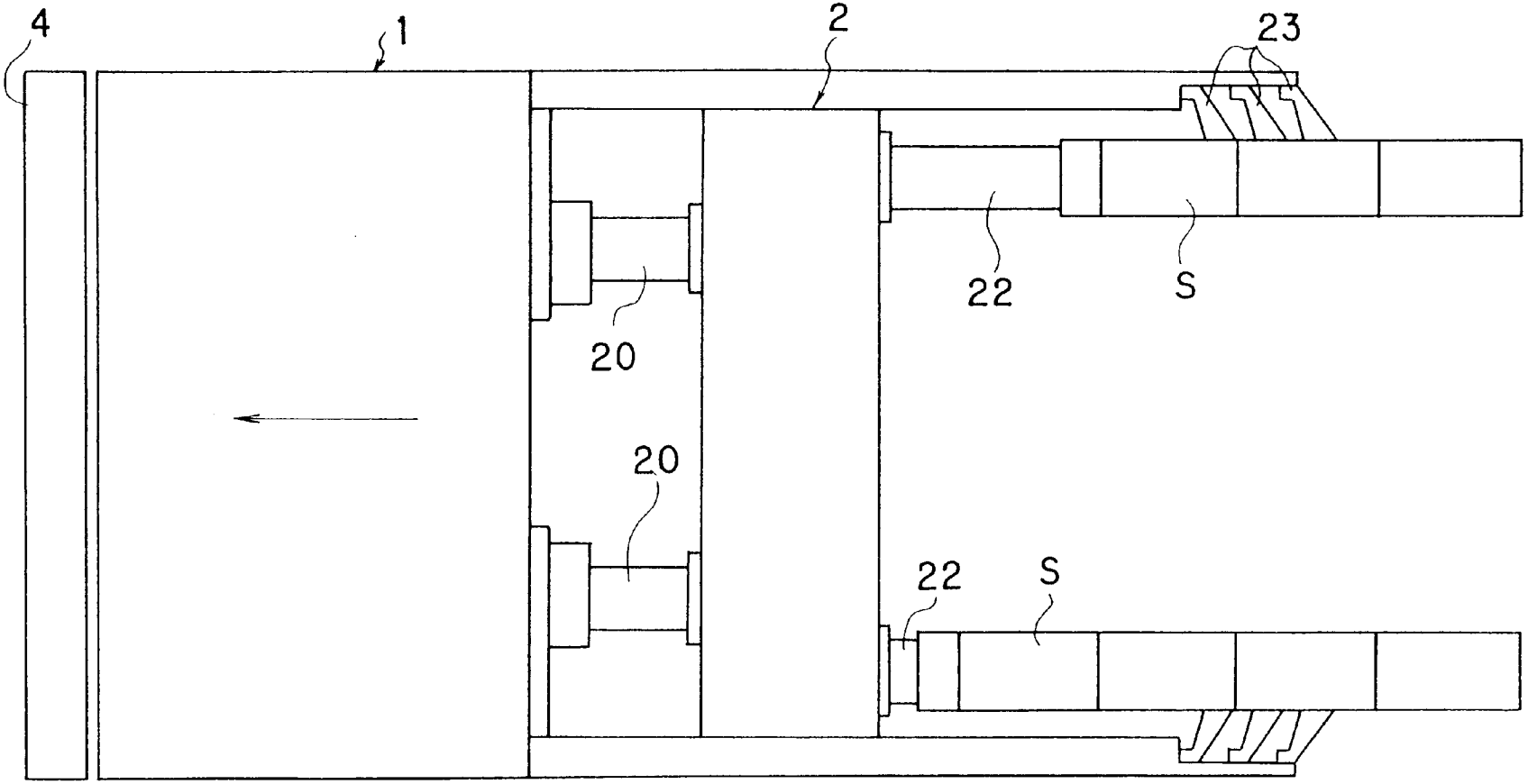
FIG. 7 is an excavating process diagram.
Figure 8:
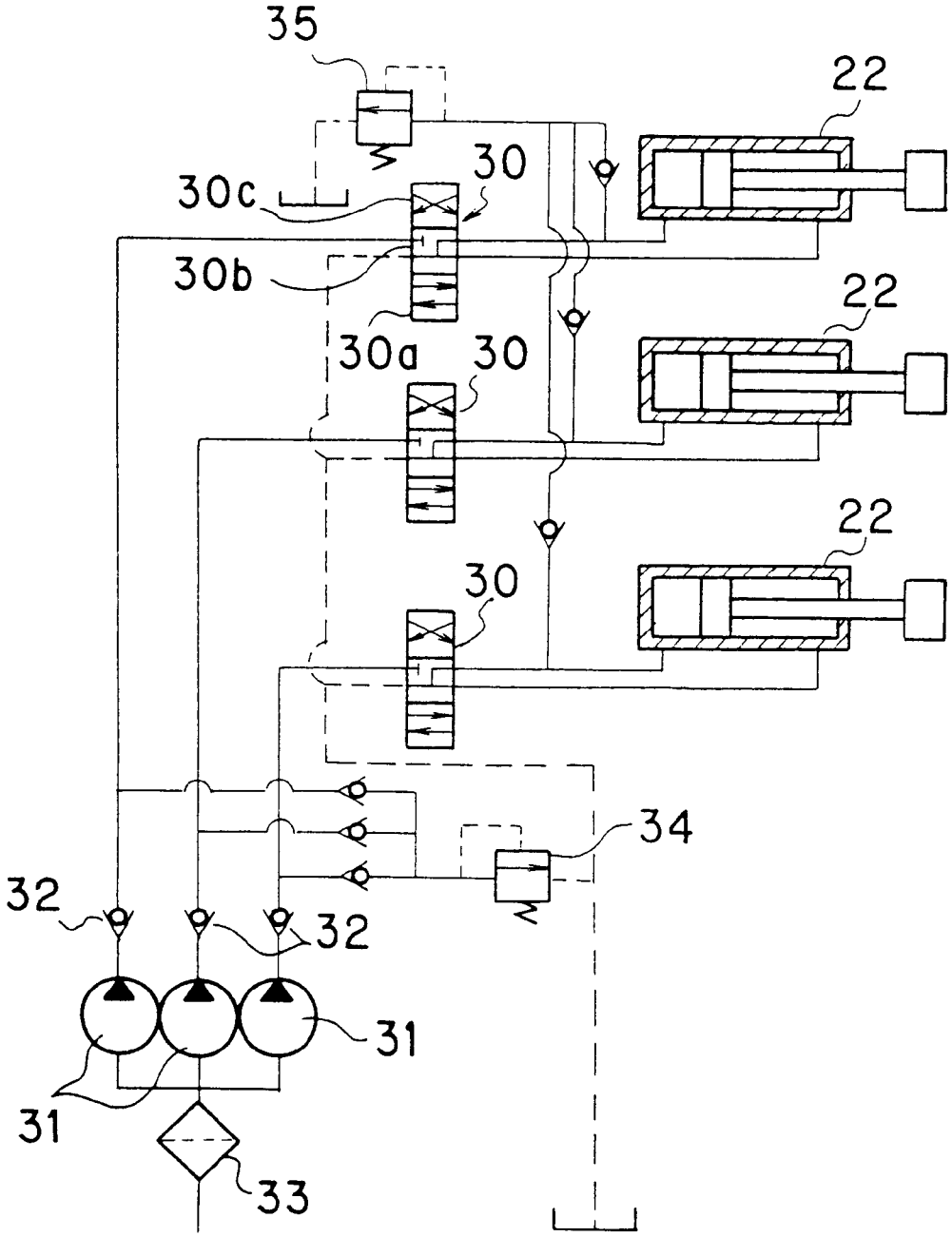
FIG. 8 is a schematic hydraulic circuit diagram of an auxiliary propulsion jack.
Figure 9:
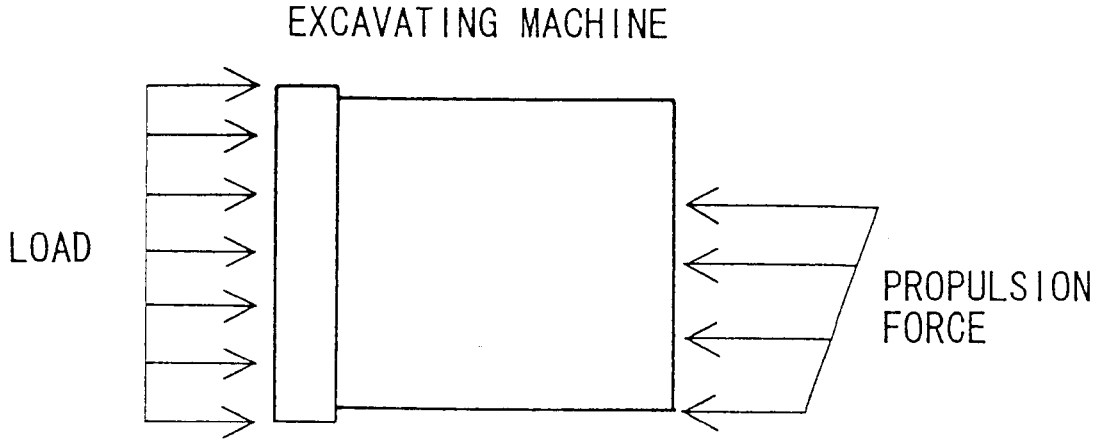
FIG. 9 is an explanatory diagram about an occurrence of propulsion in the auxiliary propulsion jack.

FIG. 1 is a side view of an earth pressure type shield excavating machine which is a tunnel excavating machine showing an embodiment of the present invention, FIG. 2 is a front view thereof, FIG. 3 is a sectional view taken along the line III—III of FIG. 1, FIGS. 4–7 are excavating process diagrams of the same, FIG. 8 is a conceptual hydraulic pressure circuit diagram of an auxiliary propulsion jack and FIG. 9 is an explanatory diagram about an occurrence of propulsion in the same auxiliary propulsion jack.

As shown in FIGS. 1, 2, the main body of the earth pressure type shield excavating machine of this embodiment comprises a cylindrical excavating machine main portion 1 and a cylindrical excavating machine auxiliary portion 2 incorporated in the excavating machine main portion 1 movably in the back and forth direction (in the length direction of a tunnel), these portions being formed in the form of double cylinders. The excavating machine main portion 1 is divided into a front excavating machine main portion la and a rear excavating machine main portion 1*b* in the back and forth direction.

A cutter head 4 is mounted rotatably through a bearing or the like on a partition wall (bulk head) 3 of the aforementioned front excavating machine main portion 1*a*. Cutter spokes 5, a plurality of cutter bits 6, and roller cutters 7 are fixed radially on a front face of a cutter head 4 and. An appropriate number of copy cutters 9 are mounted such that they can be extended or retracted (emerge) in the diameter direction of the cutter head 4 by means of a hydraulic jack 8. A ring gear 10 is fixed at the rear portion of the cutter head 4.

On the other hand, a cutter rotating motor 11 is installed to the aforementioned partition wall 3 as a cutter driving means, such that a driving gear 12 of this cutter rotating motor 11 meshes with the aforementioned ring gear 10. Therefore, if the cutter rotating motor 11 is activated so as to rotate the driving gear 12, the cutter head 4 is rotated via the ring gear 10. A rotary joint 13 is installed in the center of the partition wall 3, so that pressurized oil is supplied to the hydraulic jack 8 of the aforementioned copy cutter 9 through the rotary joint 13 from a hydraulic pressure source (not shown) and discharged. An appropriate number of foldable jacks 15 are disposed between an outside peripheral portion of the partition wall 3 and a ring-shaped reinforcing portion 14 provided in front of the rear excavating machine main portion 1*b*.

A screw conveyor 16 is disposed through the excavating machine auxiliary portion 2 within the front excavating machine main portion 1*a* and the rear excavating machine main portion 1*b*, so that soil and sand excavated by the cutter head 4 can be discharged to the rear of the tunnel. That is, a front end portion (fetching port) of the screw conveyor 16 passes through a bottom portion of the partition wall 3 and is opened into a chamber 17 defined by the cutter head 4 and the partition wall 3. A discharge port (opened/closed by a gate 19 for driving the jack 18) provided in a rear bottom portion opposes the belt conveyor (not shown) disposed in the length direction within the tunnel. This screw conveyor 16 has screw blades 16*c* provided with a cylindrical pipe 16*a* inclined such that it is raised as it goes backward, so that the screw blades can be rotated by a driving motor 16*b*.

As shown in FIG. 3, a plurality of main propulsion jacks 20 are disposed between the ring-shaped reinforcing portion 14 of the rear excavating machine main portion 1*b* and an internal peripheral portion of the excavating machine auxiliary portion 2 such that they are spaced at a predetermined interval in the circumferential direction. A plurality of auxiliary propulsion jacks 22, capable of being extended/retracted with respect to a segment S constructed (assembled) on an internal circumferential face of a tunnel as covering member, are disposed on the external circumferential portion of the excavating machine auxiliary portion 2 such that they are spaced at a predetermined interval in the circumferential direction.

A rear end of the rear excavating machine main portion 1*b* is fit to the external periphery of the existing segment S through a tail seal 23. A supporting member 24 is assembled at the rear portion of the excavating machine auxiliary portion 2 and then, an erector 25 for assembling the aforementioned segments S and a segment adjuster 26 for maintaining circularity of the segments S assembled are mounted on this supporting member 24.

As shown in FIG. 8, a hydraulic circuit for the aforementioned plurality of the auxiliary propulsion jacks 22 employs a hydraulic circuit for controlling a propulsion speed using a multi-link pump (a multi-port type pump may be used).

Each of the aforementioned auxiliary propulsion jacks 22 is connected to each of the hydraulic pumps 31 having the same capacity through each retractable selection valve 30 comprising an extension side port 30*a*, a neutral port 30*b*, and a retraction side port 30*c* and further through each check valve 32. A discharge amount of each of these hydraulic pump 31 is controlled by a controller (not shown) so that each auxiliary propulsion jacks 22 produces a propulsion force (see FIG. 9) depending on a load when the excavating machine is advanced. In FIG. 8, reference numeral 33 denotes a strainer, reference numeral 34 denotes a relief valve for setting original pressure and reference numeral 35 denotes a relief valve for preventing a damage of the jack.

Excavating process with the aforementioned earth pressure type shield excavating machine will be described with reference to FIGS. 4–7.

Figure 4:
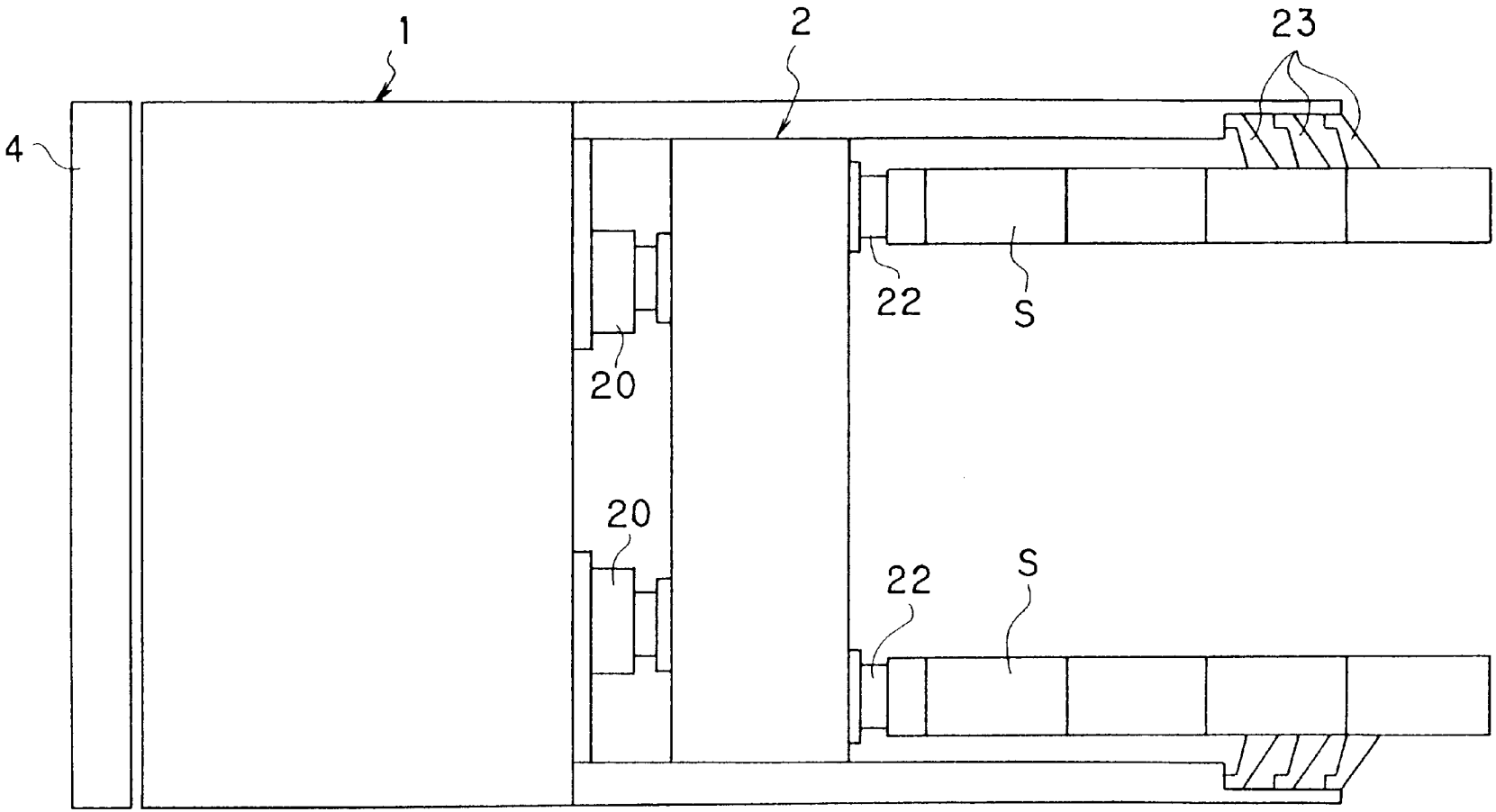
FIG. 4 is an excavating process diagram.

First of all, at an initial position in which all the main propulsion jacks 20 and auxiliary propulsion jacks 22 are retracted, the cutter rotating motor 11 is activated so as to rotate the cutter head 4 (see FIG. 4).

Figure 5:
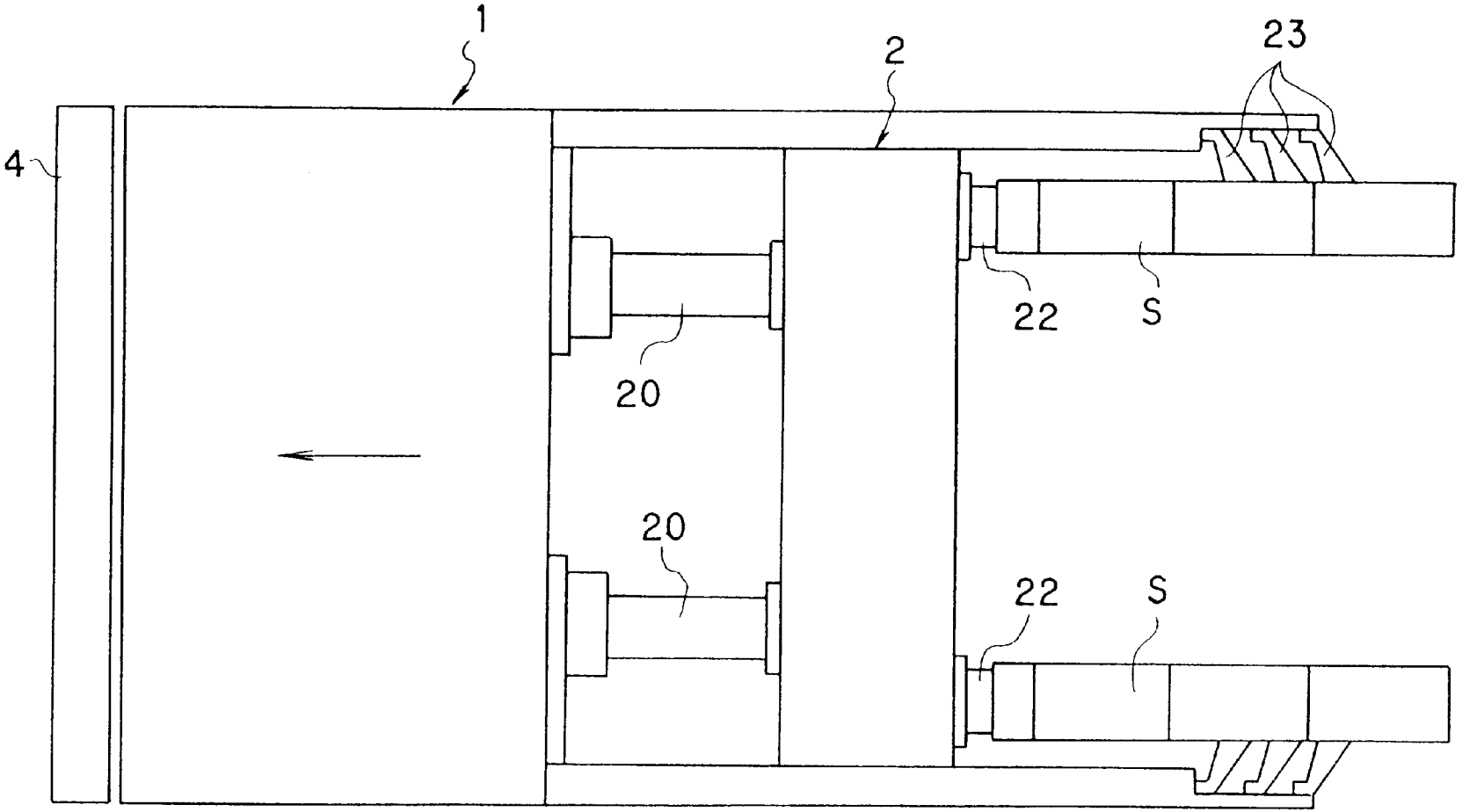
FIG. 5 is an excavating process diagram.

Next, all the main propulsion jacks 20 are extended from the aforementioned condition so as to propel (advance) the excavating machine main portion 1 by a stroke (see the first process of FIG. 5). At this time, a propulsion reaction force is received by the existing segments S through the excavating machine auxiliary portion 2. By this propulsion, a plurality of the cutter bits 6 and roller cutters 7 mounted on the cutter head 4 excavate fore ground. Sand and soil excavated are discharged outside from the chamber 17 by the screw conveyor 16 or the like.

Next, while retracting all the main propulsion jacks 20 with a rotation of the cutter head 4 stopped (depending on the case, it may not be stopped), all the auxiliary propulsion jacks 22 are extended so as to propel the excavating machine auxiliary portion 2 by a stroke for reset (see a second process of FIG. 6). At this time, a propulsion reaction force is received by the existing segment S. Consequently, the main propulsion jacks 20 are in full retraction condition so that they stand by for propulsion and at the same time, all the auxiliary propulsion jacks 22 are fully extended so as to be capable of assembling segments.

Next, while the cutter head 4 are rotating, all the main propulsion jacks 20 are extended and the excavating machine main portion 1 is propelled, while the auxiliary propulsion jacks 22 are partially retracted in succession so as to assemble the segments S with the erector 25 and the segment adjuster 26 and maintain the circularity (see the third step in FIG. 7).

Hereinafter, the aforementioned second and third processes are repeated so as to excavate and form a tunnel of a predetermined length.

In the earth pressure type shield excavating machine of this embodiment, in the third process, the segments S can be assembled under propulsion and excavation with the excavating machine main portion 1 and it is permissible not to stop the excavating main body during assembly of the segments S unlike the conventional ordinary shield excavating machine, thereby enabling high-speed construction.

On the other hand, there is any retracting motion between the front body and rear body unlike the conventional high-speed construction type shield excavating machine, so that it is possible to stop water from entering completely and prevent damage of the sealing mechanism and the like. Further, because there is no relative motion between the erector 25/the segment adjuster 26 and the existing segment S at the time of assembly of the segments, the segments S can be assembled easily at a high precision. Still further, because the erector 25 and the segment adjuster 26 are provided on the excavating machine auxiliary portion 2 such that they are movable integrally, not only the erector 25 and the segment adjuster 26 do not have to be advanced individually when the excavating machine is advanced but also construction efficiency can be raised thereby accelerating the aforementioned high-speed.

In the meantime, an excavation amount per week with the earth pressure type shield excavating machine of this embodiment can be expressed with a following equation (1) and an excavation amount per week with the conventional ordinary shield excavating machine can be expressed with a following equation (2).

$$L = \{W/(W/v + tr)\} \times 60/1000 \times Td \times Dw \times n \quad \ldots (1)$$

| | |
|---|---|
| where | |
| L: excavation amount per week | m/week |
| W: segment width | mm/ring |
| v: excavating speed | mm/min |
| tr: reset time | mm/ring |
| Td: working time per day | hr/day |
| Dw: working days per week | day/week |
| n: availability | % |
| Here, | |
| W: 1500 | mm/ring |
| v: 30 | mm/min |
| tr: 10 | mm/ring |
| Td: 24 | hr/day |
| Dw: 6 | day/week |
| n: 64 | % |
| therefore L: 138 | m/week |

$$L = \{W/(W/v + ts)\} \times 60/1000 \times Td \times Dw \times n \quad \ldots (2)$$

| | |
|---|---|
| where | |
| L: excavation amount per week | m/week |
| W: segment width | mm/ring |
| v: excavating speed | mm/min |
| ts: segment assembly time | mm/ring |
| Td: working time per day | hr/day |
| Dw: working days per week | day/week |
| n: availability | % |
| here, | |
| W: 1500 | mm/ring |
| v: 30 | mm/min |
| ts: 40 | mm/ring |
| Td: 24 | hr/day |
| Dw: 6 | day/week |
| n: 64 | % |
| therefore L: | 92 m/week |

In the earth pressure type shield excavating machine of this embodiment, only the reset time determined depending upon the capacity of the hydraulic pump 31 by neglecting the segment assembly time has to be considered, so that a higher speed construction can be achieved as compared to the conventional ordinary shield excavating machine.

As described above, in the hydraulic circuit for the aforementioned plurality of the auxiliary propulsion jacks 22, the propulsion speed is controlled using the multi-link pump 31. Therefore, the discharge amount of the hydraulic pump 31 is controlled so as to produce a propulsion corresponding to a load of the auxiliary propulsion jacks 22 when the excavating machine is advanced (see FIGS. 8, 9)

Consequently, in the above described third process, the auxiliary propulsion jacks 22 are partially retracted successively, so that when assembling the segments S with the erector 25, an occurrence of a rotation moment is suppressed to avoid a bending of the excavating machine and the like.

Figure 10:
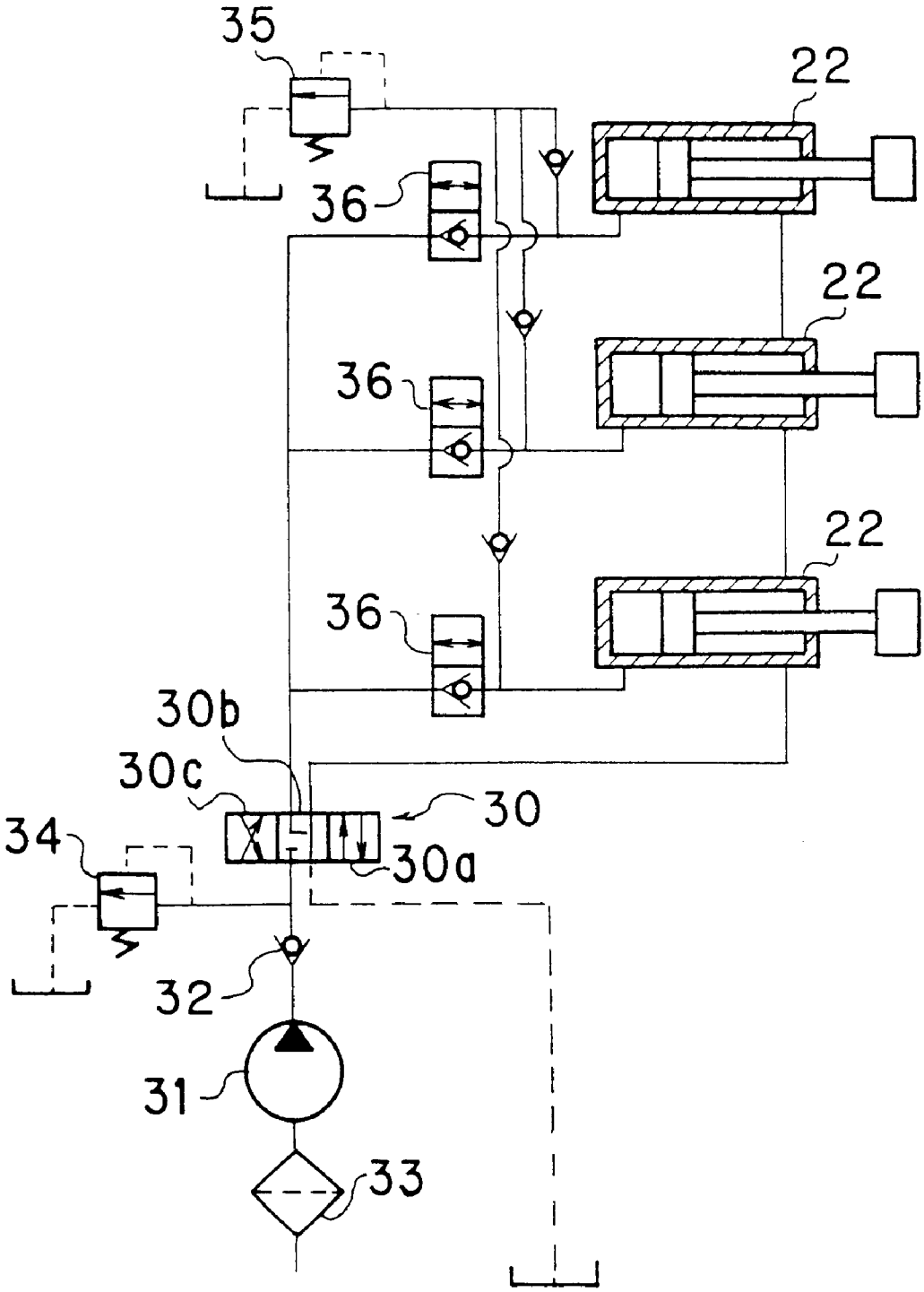
FIG. 10 is a schematic hydraulic circuit diagram of a conventional shield jack.
Figure 11:
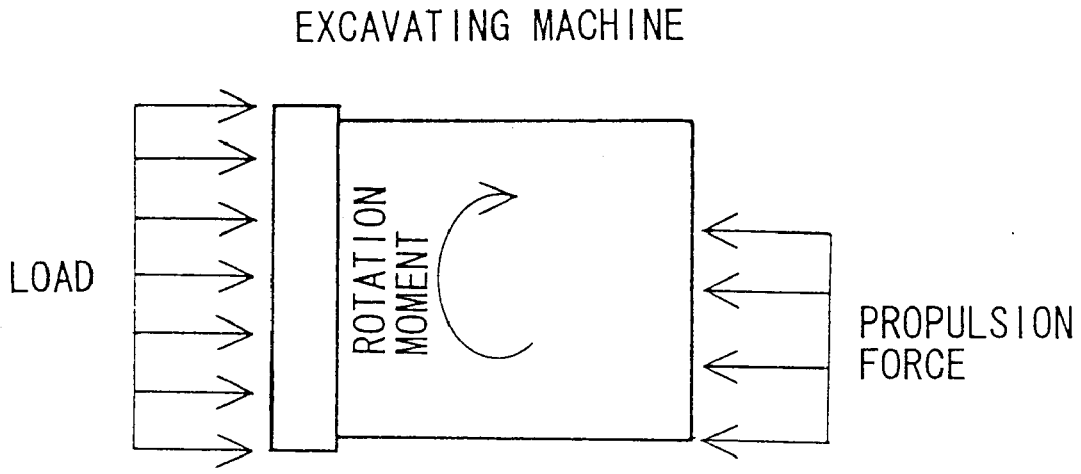
FIG. 11 is an explanatory diagram about an occurrence of propulsion of the same shield jack.

For example, if each of the auxiliary propulsion jacks 22 is connected to a single hydraulic pump 31 through each retractable selection valve 30, as shown in a schematic hydraulic circuit diagram of a conventional shield jack shown in FIG. 10, the propulsion force of each auxiliary propulsion jacks 22 would be equal, as shown in FIG. 11, because the same hydraulic pressure source is employed.

Thus, if the auxiliary propulsion jacks 22 are partially retracted by means of the retractable selection valve 30 and a predetermined jack selection valve 36 at the time of the aforementioned segment assembly or the like, as shown in FIG. 11, a rotation moment is applied to the excavating machine so that a bending occurs in the excavating machine. In FIG. 10, like reference numerals are attached to like members of FIG. 8 and a description thereof is omitted.

According to this embodiment, in the auxiliary propulsion jacks 22, at the time of extension motion, plural pieces thereof are controlled as a group while at the time of retraction, each piece thereof is controlled. Consequently, the auxiliary propulsion jacks 22 can be retracted effectively depending upon the assembly condition of the segment and at the time of propulsion, each of the auxiliary propulsion jacks 22 can be made to easily follow an inclination of the existing segment S.

Although according to this embodiment, the tunnel excavating machine of the present invention has been described in conjunction with the earth pressure type shield excavating machine, it may be applied to a muddy water type shield excavating machine or a tunnel boring machine. It is needless to say that the present invention may be modified in various ways in a range not departing from the gist of the present invention.

As described in detail above, the tunnel excavating machine of the present invention comprises: a cylindrical excavating machine main portion which is provided with a cutter head mounted rotatably at a front portion thereof and fit to an external periphery of a covering member through a sealing member; a cylindrical excavating machine auxiliary portion which is fit to the inside of the excavating machine main portion movably in the back and forth direction and provided with an erector for assembling the covering members; a plurality of main propulsion jacks disposed between the excavating machine main portion and the excavating machine auxiliary portion; and a plurality of auxiliary propulsion jacks mounted on the excavating machine auxiliary portion and capable of being retracted with respect to the covering member, wherein assembly of the covering members is enabled under propulsion and excavation with the excavating machine main portion. Therefore, it is possible to provide a tunnel excavating machine of high-speed construction type capable of stopping invasion of water completely and allows the covering members to be assembled easily.

Further, in the tunnel excavating machine, the plurality of the auxiliary propulsion jacks are connected to separate hydraulic pressure sources, each having the same capacity, through each of retractable selection valves. Therefore, there is an advantage that a bending or the like of the excavating machine, when the auxiliary propulsion jacks are partially retracted at the time of assembly of the covering members or the like, can be avoided.

Further, in the tunnel excavating machine, the plurality of the auxiliary propulsion jacks are so controlled that at the time of extension motion, the plurality of the auxiliary propulsion jacks are controlled as a group, while at the time of retraction, each of the auxiliary propulsion jacks is controlled separately. Therefore, there is an advantage that the auxiliary propulsion jacks can be retracted effectively depending upon assembly condition of the covering members and further each of the auxiliary propulsion jacks can be made to follow an inclination of the covering member at the time of propulsion.

Yet further, the tunnel excavation method of the present invention has a feature that, upon excavating and forming a tunnel with the tunnel excavating machine, includes the steps of: executing a first step of, with all of the main propulsion jacks extended from an initial position wherein the main propulsion jacks and all of the an auxiliary propulsion jacks are both retracted, propelling an excavating machine main portion; executing a second step of, with all of the auxiliary propulsion jacks extended while retracting the main propulsion jacks, propelling the excavating machine auxiliary portion, and executing a third step of, while propelling the excavating machine main portion with the main propulsion jacks extended, retracting each of the auxiliary prolusion jacks partially in succession so as to assemble a plurality of covering members one at a time with an erector. The second step and the third step are repeated.

What is claimed is:

1. A tunnel excavating machine, comprising:

a cylindrical excavating machine main portion provided with a cutter head mounted rotatably at a front portion thereof and fit to an external periphery of a covering member through a sealing member;

a cylindrical excavating machine auxiliary portion fit to the inside of said excavating machine main portion movably in back and forth directions, the cylindrical excavating machine auxiliary portion having an erector integrally attached thereto for assembling said covering members;

a plurality of main propulsion jacks disposed between said excavating machine main portion and said excavating machine auxiliary portion; and a plurality of auxiliary propulsion jacks mounted on said excavating machine auxiliary portion and capable of being retracted with respect to said covering member, wherein assembly of said covering members is enabled under propulsion and excavation with said excavating machine main portion, and, wherein the plurality of said auxiliary propulsion jacks are controlled so that, at the time of extension motion, the plurality of the auxiliary propulsion jacks are controlled as a group, while at the time of retraction, each of the auxiliary propulsion jacks is controlled separately so as to provide successive retraction, at least partially, for sequentially assembling a plurality of covering members.

2. A tunnel excavating machine as claimed in claim 1, wherein the plurality of said auxiliary propulsion jacks are connected to separate hydraulic pressure sources each having the same capacity through each of retractable selection valves.

3. A tunnel excavating machine as claimed in claim 1 and additionally including a covering member adjuster integrally attached to the auxiliary portion for maintaining circularity of assembled covering members.

4. A tunnel excavation method for excavating and forming a tunnel with the tunnel excavating machine having a main portion provided with a cutter head mounted rotatably at a front portion thereof, an auxiliary portion provided inside the main portion movably in back and forth directions and provided with an erector integrally attached to the auxiliary portion for assembling the covering members, a plurality of main propulsion jacks disposed between the main portion and the auxiliary portion, and a plurality of auxiliary propulsion jacks mounted on the auxiliary portion and capable of being retracted with respect to the covering member, comprising:

propelling the main portion by extending the main propulsion jack from an initial position wherein the main propulsion jacks and the auxiliary propulsion jacks are both retracted;

propelling the auxiliary portion by extending the auxiliary propulsion jacks while retracting the main propulsion jacks;

propelling the main portion by extending the main propulsion jacks while partially retracting each of the auxiliary propulsion jacks in succession; and sequentially assembling the covering members by the erector.

5. The method of claim 4 wherein the step of assembling is carried out simultaneously with the step of propelling the main portion.

6. A tunnel excavating machine, comprising:

a main portion provided with a cutter head mounted rotatably at a front portion thereof and fit to and external periphery of a covering member through a sealing member;

an auxiliary portion provided inside the main portion, the auxiliary portion being movable in back and forth directions;

an erector integrally attached to the auxiliary portion for assembling covering members;

a plurality of main propulsion jacks disposed between the main portion and the auxiliary portion; and a plurality of auxiliary propulsion jacks mounted on the auxiliary portion, the propulsion jacks being capable of being extended as a group and individually retracted successively with respect to the covering member for sequentially assembling a plurality of covering members with the erector.

7. A tunnel excavating machine as claimed in claim 6 and additionally including a covering member adjuster attached to the auxiliary portion for maintaining circularity of assembled covering members.

8. A method of manufacturing a tunnel excavating machine, comprising the steps of:

providing a main portion having a cutter head mounted rotatably at a front portion thereof and fit to and external periphery of a covering member through a sealing member;

providing, inside the main portion, an auxiliary portion movable in back and forth directions;

integrally attaching an erector to the auxiliary portion for assembling covering members;

providing a plurality of main propulsion jacks between the main portion and the auxiliary portion; and mounting a plurality of auxiliary propulsion jacks on the auxiliary portion, the propulsion jacks being capable of being extended as a group and individually retracted successively for sequentially assembling a plurality of covering members with the erector.

9. The method as claimed in claim 8 and additionally including the step of integrally attaching a covering member adjuster to the auxiliary portion for maintaining circularity of assembled covering members.

10. A tunnel excavating machine, comprising:

a main portion provided with a cutter head mounted rotatably at a front portion thereof and fit to and external periphery of a covering member through a sealing member;

an auxiliary portion provided inside the main portion, the auxiliary portion being movable in back and forth directions;

an erector and an adjuster integrally attached to the auxiliary portion for assembling covering members and maintaining circularity thereof following assembly;

a plurality of main propulsion jacks disposed between the main portion and the auxiliary portion; and a plurality of auxiliary propulsion jacks mounted on the auxiliary portion, the propulsion jacks being capable of being extended as a group and separately retracted successively with respect to the covering member for individually assembling a plurality of covering members with the erector.

11. A tunnel excavation method for excavating and forming a tunnel with the tunnel excavating machine having a main portion provided with a cutter head mounted rotatably at a front portion thereof, an auxiliary portion provided inside the main portion movably in back and forth directions and provided with an erector integrally attached to the auxiliary portion for assembling the covering members, a plurality of main propulsion jacks disposed between the main portion and the auxiliary portion, and a plurality of auxiliary propulsion jacks mounted on the auxiliary portion and capable of being retracted with respect to the covering member, comprising:

propelling the main portion by extending the main propulsion jack from an initial position wherein the main propulsion jacks and the auxiliary propulsion jacks are both retracted;

propelling the auxiliary portion by extending the auxiliary propulsion jacks while retracting the main propulsion jacks;

propelling the main portion by extending the main propulsion jacks while partially retracting each of the auxiliary propulsion jacks in succession; and sequentially assembling the covering members by the erector while simultaneously propelling the main portion.

* * * * *